US007007743B2

(12) United States Patent
Calhoun et al.

(10) Patent No.: US 7,007,743 B2
(45) Date of Patent: Mar. 7, 2006

(54) HEADER TANK WITH INTEGRAL MOUNTING FLANGE

(75) Inventors: Chris A. Calhoun, Niagara Falls, NY (US); Terry Joseph Hunt, Williamsville, NY (US); David A. Southwick, Lockport, NY (US); Karl Paul Kroetsch, Williamsville, NY (US); Krzysztof Wawrocki, Ostrow Wlkp. (PL); Khalid El Moutamid, Vivier Au Court (FR); Yusuke Matsunaga, Amherst, NY (US); Laurent Art, Ethe (BE)

(73) Assignee: Delphi Technologies, Inc., Troy, MI (US)

( * ) Notice: Subject to any disclaimer, the term of this patent is extended or adjusted under 35 U.S.C. 154(b) by 137 days.

(21) Appl. No.: 10/715,098

(22) Filed: Nov. 17, 2003

(65) Prior Publication Data

US 2005/0103485 A1 May 19, 2005

(51) Int. Cl.
*F28F 9/007* (2006.01)

(52) U.S. Cl. ..... 165/67; 165/173; 29/890.052

(58) Field of Classification Search ..... 165/67, 165/173; 29/890.052
See application file for complete search history.

(56) References Cited

U.S. PATENT DOCUMENTS

| | | | | |
|---|---|---|---|---|
| 4,770,240 | A * | 9/1988 | Dawson et al. | 165/176 |
| 5,163,509 | A * | 11/1992 | Dawson | 165/176 |
| 5,172,762 | A * | 12/1992 | Shinmura et al. | 165/173 |
| 5,628,361 | A * | 5/1997 | Getto | 165/67 |
| 5,649,588 | A * | 7/1997 | Lee | 165/67 |
| 6,129,146 | A * | 10/2000 | Krueger et al. | 165/173 |
| 6,167,953 | B1 * | 1/2001 | Kobayashi et al. | 165/173 |
| 6,173,765 | B1 * | 1/2001 | Uchikawa et al. | 165/173 |

FOREIGN PATENT DOCUMENTS

| | | | |
|---|---|---|---|
| EP | 1191298 | A2 * | 3/2002 |
| JP | 2002195780 | A * | 7/2002 |

* cited by examiner

*Primary Examiner*—Allen J. Flanigan
(74) *Attorney, Agent, or Firm*—Patrick M. Griffin

(57) ABSTRACT

A one-piece header tank includes side edges that are overlapped and brazed together to form a joint positioned within the interior of the tank. The tank also includes an integrally formed mounting flange that may be fabricated without jeopardizing the leak integrity of the tank.

18 Claims, 4 Drawing Sheets

HEADER TANK WITH INTEGRAL MOUNTING FLANGE

BACKGROUND OF THE INVENTION

1. Field of the Invention

The subject invention relates to a one-piece aluminum heat exchanger tank and a method for fabricating such a tank.

2. Description of the Related Art

Various heat exchanger tanks exist in the art that are formed from a single sheet of metallic material. These one-piece tanks are typically fabricated by rolling an aluminum-clad sheet into a structure having integrally formed sidewalls and then joining two opposed side edges of the walls together along a common joint. The resulting tank is then connected to a core subassembly using conventional nuts and gasket seals in combination with discrete mounting brackets that must be positioned on the tank before the tank is connected to the core.

An example of a one-piece aluminum tank which utilizes separate mounting brackets for mounting the tank to a radiator core is disclosed in U.S. Pat. No. 6,167,953 ("Kobayashi et al."). The Kobayashi et al., tank features a cylindrical body formed by brazing opposed end edges of an aluminum sheet together to form a joint that extends along the length of the tank. Specifically, one of the end edges of the joint overlaps the other on the exterior surface of the tank.

Although forming a single, overlapping joint on the exterior of the Kobayashi et al., tank arguably reduces the number of steps required to fabricate the tank, it does nothing to minimize the space occupied by the tank once it has been connected to a core subassembly. It also creates a rough, marred exterior surface which is so uneven that it renders the tank unuseable. Furthermore, the process of connecting the tank to the core is complicated by the use of the discrete mounting brackets. Each bracket must be separately brazed to the exterior of the tank before the tank can be attached to the core. Given the recent attention focused on creating an aluminum radiator that eliminates the header crimp area between the core and tanks, the marred surface created by overlapping the mounting brackets and exterior joint of the Kobayashi et al., invention fails to provide a suitable solution for minimizing the space occupied by a one-piece header tank.

Although Kobayashi et al., and other references specifically disclose aluminum tanks having brazed joints and which are mounted onto cores using separate brackets, the references fail to provide any type of connecting joints that are strong, yet result in a tank having a space-saving and smooth exterior surface. The references also do not disclose a tank featuring such a joint in combination with an integrally-formed bracket or rail for use in connecting the tank to a core.

BRIEF SUMMARY OF THE INVENTION AND ADVANTAGES

The invention provides a heat exchanger tank formed from a single sheet of clad material. The sheet extends through a rectangular cross-section and defines a tube wall with tube holes extending therethrough. A parallel joint wall is spaced from the tube wall. Spaced parallel sidewalls interconnect the joint and tube walls to define a chamber and opposed open ends. The joint wall has an integrally formed tab that extends therefrom into the chamber. A first of the sidewalls is disposed in sealing engagement with the outside of the tab to enclose the tab within the chamber.

The subject invention also provides a method of fabricating a heat exchanger tank. The method includes the step of forming a single sheet of material with a cladding on at least one surface thereof to define a tank extending through a rectangular cross-section and having a tube wall, a parallel joint wall spaced from the tube wall, and spaced parallel sidewalls interconnecting the joint and tube walls to define a chamber having opposed open ends. An additional step is forming an integral tab extending from the joint wall into the chamber. A first of the sidewalls is disposed into engagement with the exterior of the tab to enclose the tab within the chamber, and brazing the first sidewall to the tab.

Accordingly, the subject invention overcomes the limitations of the related art by providing a one-piece heat exchanger tank specifically designed to minimize the exterior surface area occupied by the tank after it has been installed on a radiator core. This is achieved by providing a smooth exterior surface created by joining the opposed side edges of the tank in a manner that positions the overlapped edges inside the chamber of the tank, and by incorporating an integrally-formed mounting bracket on the tank without jeopardizing the leak integrity of the tank.

BRIEF DESCRIPTION OF THE SEVERAL VIEWS OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
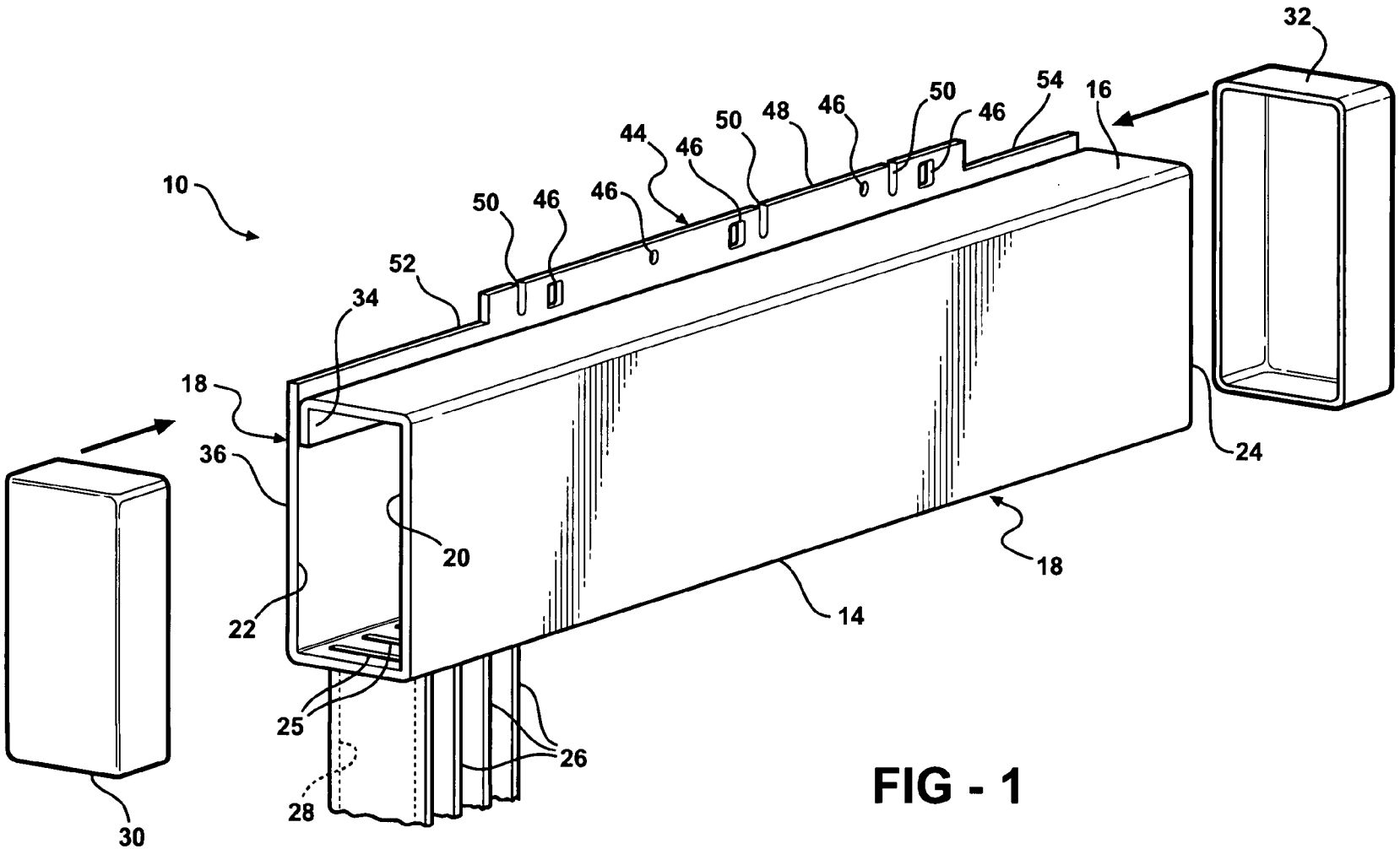
FIG. 1 is a perspective view of a heat exchanger tank according to one embodiment of the present invention and showing end caps.
Figure 2:
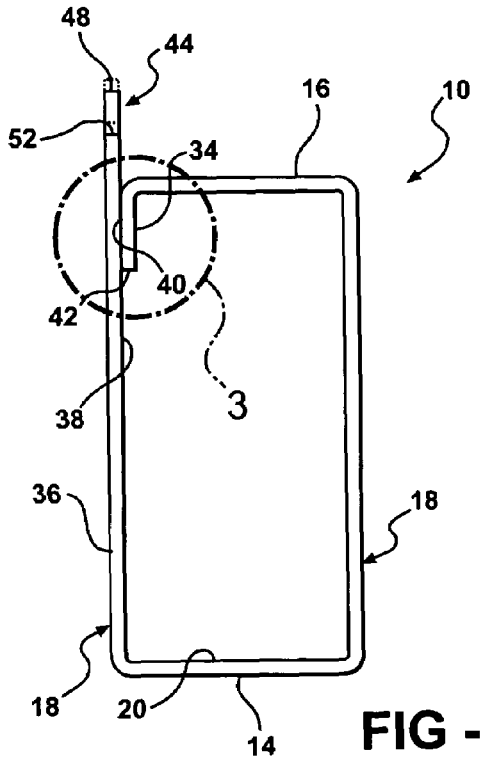
FIG. 2 is an end view of the tank of FIG. 1.
Figure 3:
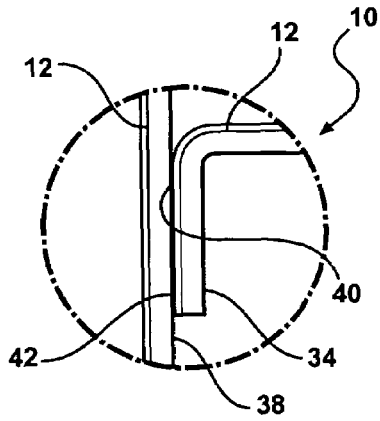
FIG. 3 is an enlarged view of the tank shown in FIG. 2 illustrating the interior braze joint.
Figure 4:
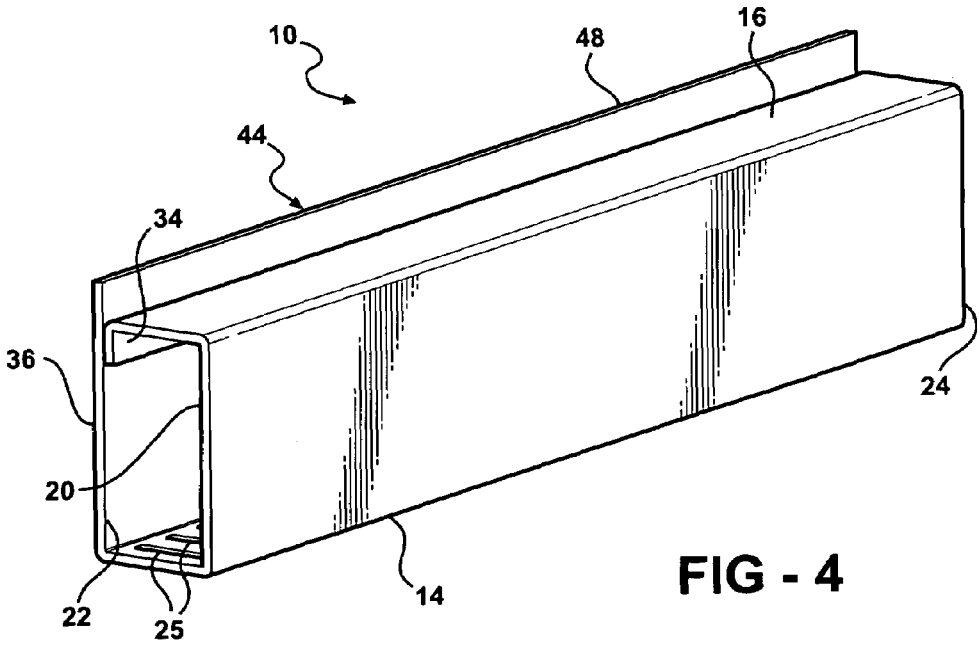
FIG. 4 is a perspective view of a tank according to FIG. 1 prior to forming holes, slots or recessed areas on the flange thereof.
Figure 5:
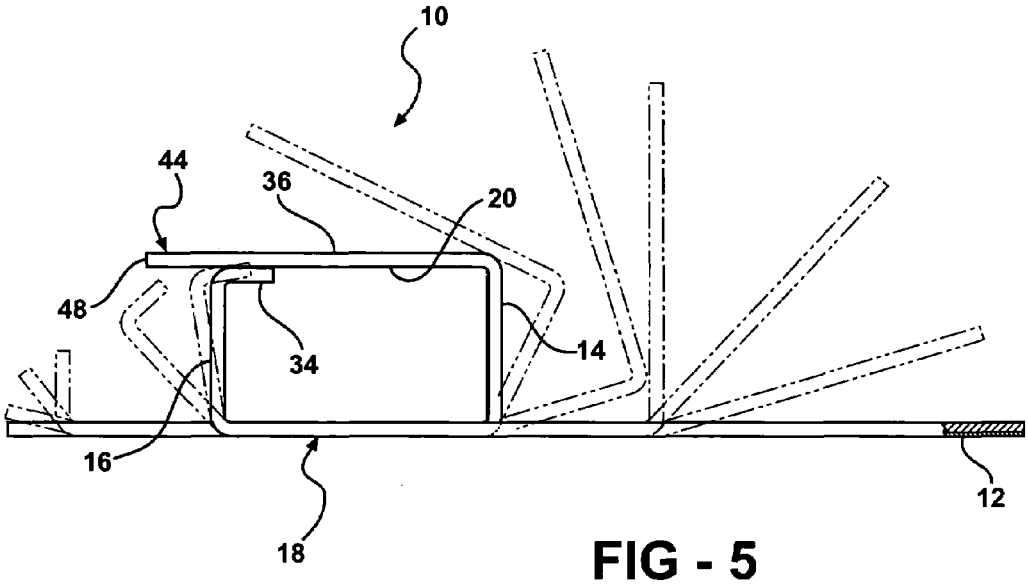
FIG. 5 is an exploded end view of the tank of FIG. 1 illustrating a method of forming the tank.
Figure 6:
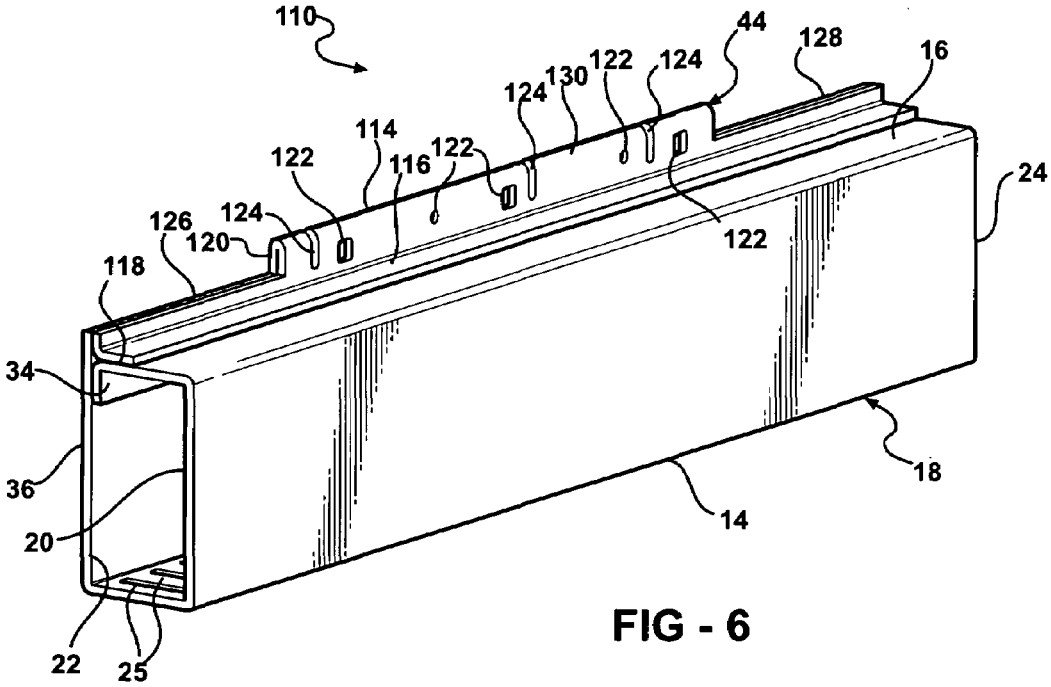
FIG. 6 is a perspective view of a heat exchanger tank according to an alternative embodiment of the present invention.
Figure 7:
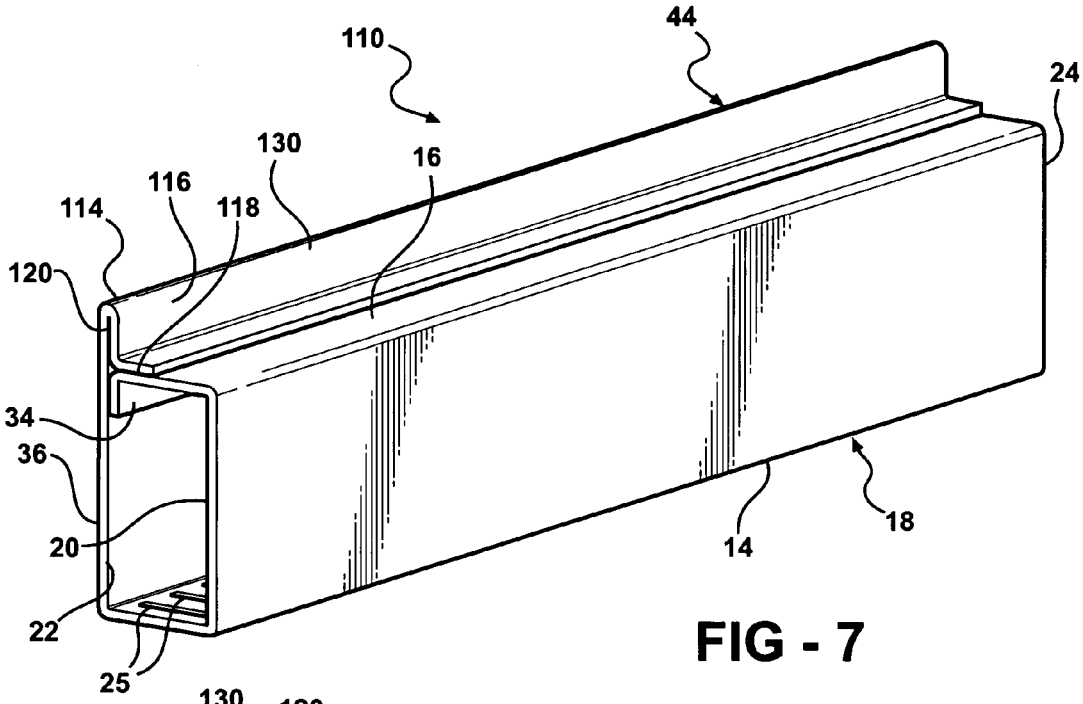
FIG. 7 is a perspective view of yet another embodiment of a tank but prior to forming holes, slots or recessed areas on the flange thereof.
Figure 8:
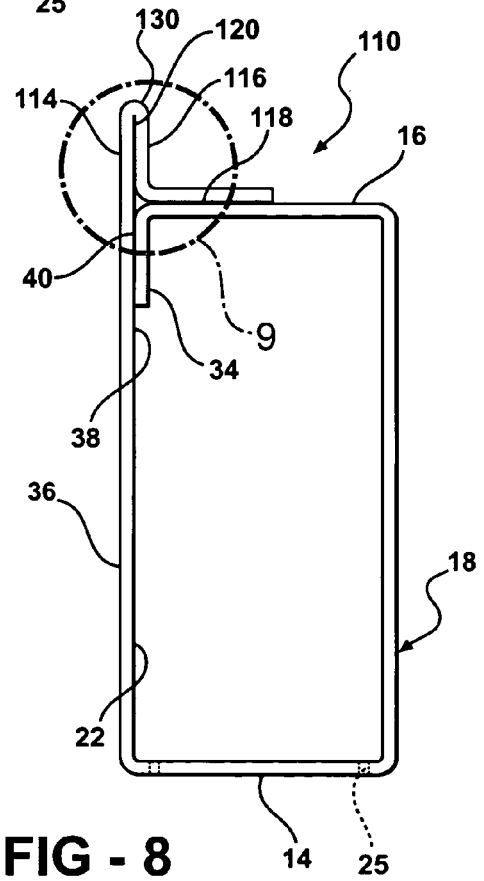
FIG. 8 is an end view of the tank shown in FIG. 7.
Figure 9:
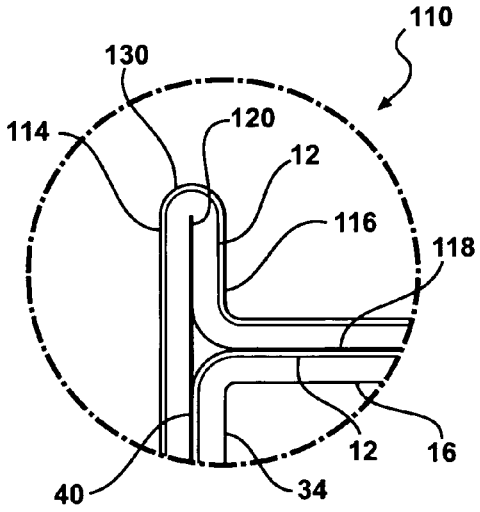
FIG. 9 is an enlarged view of the tank shown in FIGS. 6, 7 and 8 illustrating the exterior braze joint.

Referring to the Figures, wherein like numerals indicate like or corresponding parts throughout the several views, a heat exchanger tank for a cooling system is shown generally at 10 in FIG. 1, and at 110 in FIG. 6. The tank is formed from a single sheet of material having a cladding 12 on at least one surface thereof. The sheet material shown in the Figures is aluminum sheet material with 4000 series braze on the exterior surface thereof. The sheet extends through a rectangular cross-section to define a tube wall 14 and a parallel joint wall 16 spaced therefrom. Spaced parallel sidewalls 18 interconnect the joint wall 16 and tube wall 14 to define a chamber 20 and opposed open ends 22, 24 for permitting fluid flow through the tank 10. The tube wall 14 includes tube holes 25 through which elongate tubes 26 are received. Each of the tubes 26 defines a passage 28 which extends through the tube 26 to permit fluid flow into the chamber 20. End caps 30, 32, are positioned for being sealingly engaged with the open ends 22, 24 of the tank.

Each tank also includes a tab 34 integrally formed with the joint wall 16. The tab 34 extends into the chamber 20. A first sidewall 36 of the sidewalls 18 is disposed in sealing engagement with the outside of the tab 34 and encloses the tab 34 within the chamber 20. In particular, the first sidewall 36 includes an interior joint surface 38 positioned within the chamber 20. The tab 34 includes an exterior surface 40 with the cladding 12 thereon. The cladding 12 seals the exterior surface 40 into engagement with the joint surface 38 to define an internal braze joint 42 within the chamber 20.

The first sidewall 36 extends above the joint wall 16 and the tab 34 to define a mounting flange 44. The flange 44 includes a plurality of holes 46 for receiving complementary fasteners therethrough for mounting the tank 10 on the cooling system. The flange 44 has a peripheral edge 48 from which spaced slots 50 extend toward the tab 34. Like the holes 46, the slots 50 are used to mount the tank 10 to structure of the cooling system. Recessed areas 52, 54 extend from the peripheral edge 48 toward each of the ends 22, 24 of the tank for positioning the flange 44 in closely-conforming relation to the cooling system.

A heat exchanger tank according to another embodiment of the invention is shown generally at 110 in FIG. 6. With the exception of the flange, the tank 110 includes the same components and is formed from the same materials as the tank 10.

The flange 44 of the tank 110 is formed from a double thickness of the sheet material to define primary and reinforcing walls 114 and 116. The reinforcing wall 116 overlaps the primary wall 114 on the interior thereof and extends transversely over the joint wall 16 on the exterior thereof The cladding 12 on the joint wall 16 seals the reinforcing wall 116 into engagement the joint wall 16 to define an exterior braze joint 118. A U-shaped fold 120 integrally joins the reinforcing wall 116 with the primary wall 114.

Other than extending through a double thickness of sheet material rather than a single thickness, the holes 122, slots 124 and recessed areas 126, 128 on the tank 110 are identical to the respective holes 46, slots 50 and recessed areas 52, 54 of the tank 10. Furthermore, other than extending across the double thickness of the sheet material, the peripheral edge 130 from which the slots 124 extend is identical to the peripheral edge 48 of the tank 10.

The subject invention also includes a method of fabricating a heat exchanger tank. The method includes the steps of forming a single sheet of material having a cladding 12 on at least one surface thereof to define a tank 10 extending through a rectangular cross-section and having a tube wall 14 with a parallel joint wall 16 spaced from the tube wall 14. Spaced parallel sidewalls 18 interconnect the joint and tube walls 16 and 14 to define a chamber 20 having opposed open ends 22, 24. The joint wall 16 and tube wall 14 are interconnected by forming an integral tab 34 that extends from the joint wall 14 into the chamber 20, and a first sidewall 36 of the sidewalls 18 is disposed into engagement with the exterior of the tab 34 to enclose the tab 34 within the chamber 20. The first sidewall 36 is then brazed to the tab 34.

The method is further defined as extending the first sidewall 36 upwardly above the joint wall 14 and the tab 34 to project outwardly from the joint wall 14 to define a flange 44. Still another step is extending holes 46 through the flange 44 for receiving fasteners therethrough to mount the tank 10 on the cooling system. Spaced slots 50 are also formed on the flange 44 and extend from a peripheral edge 48 thereof toward the tab 34 for connecting the tank 10 to the cooling system. In addition, the method includes the step of forming a recessed area 52, 54 on each end of the flange 44 that extends from the peripheral edge 44 thereof toward an adjacent end 22, 24 of the tank 10.

The method continues in an alternative way by doubling the sheet defining the flange 44 to further define a primary wall 114 and a reinforcing wall 116. The method is further defined by forming a U-shaped fold 120 which integrally joins the primary wall 114 and reinforcing wall 116. The method also includes the step of overlapping the primary wall 114 and the joint wall 16 with the reinforcing wall 116. The reinforcing wall 116 is then brazed to the primary wall 114 and the joint wall 16.

A final step is sealing end caps 30, 32 with the open ends 22, 24 on each of the tanks 10, and 110.

Obviously, many modifications and variations of the present invention are possible in light of the teachings set forth above. The invention may be practiced other than as specifically described within the scope of the claims. Furthermore, the foregoing description of the preferred embodiment of the invention and the best mode for practicing the invention are provided for the purpose of illustration only and not for the purpose of limitation—the invention being defined by the claims.

We claim:

1. A heat exchanger tank for a cooling system comprising;

a single sheet of material having a cladding on at least one surface thereof and extending through a rectangular cross-section defining a tube wall having tube holes therein and a parallel joint wall spaced from said tube wall with spaced parallel sidewalls interconnecting said joint and tube walls to define a chamber and opposed open ends for permitting fluid flow through said tank, said tank characterized by said joint wall including a tab integrally formed therewith and extending from said joint wall into said chamber and a first of said sidewalls disposed in sealing engagement with the outside of said tab to thereby enclose said tab within said chamber, said first sidewall extending above said joint wall and said tab to define a mounting flange for mounting said tank on the cooling system, and said flange being of a double thickness of said sheet to define a primary wall and a reinforcing wall.

2. A tank as recited in claim 1 wherein said flange includes a plurality of holes for receiving fasteners therethrough for mounting said tank on the cooling system.

3. A tank as recited in claim 1 wherein said flange includes a peripheral edge with spaced slots extending therefrom toward said tab for mounting said tank to the cooling system.

4. A tank as recited in claim 1 wherein said flange includes a peripheral edge with recessed areas extending therefrom said peripheral edge toward each of said ends of the tank for positioning said flange in closely-conforming relation to the cooling system.

5. A tank as recited in claim 1 wherein said first sidewall includes an interior joint surface within said chamber and said tab includes an exterior surface with said cladding thereon sealing said exterior surface into engagement with said joint surface to define an internal braze joint within said chamber.

6. A tank as recited in claim 1 including a U-shaped fold integrally joining said primary and reinforcing walls and extending parallel to the longitudinal axis of said tank.

7. A tank as recited in claim 1 wherein said reinforcing wall overlaps said primary wall on the interior thereof and extends transversely over said joint wall on the exterior thereof.

8. A tank as recited in claim 7 wherein said cladding seals said reinforcing wall into engagement with said primary wall and said joint wall to define an exterior braze joint.

9. A tank as recited in claim 1 and including end caps sealingly engaged with said open ends of said tank.

10. A tank as recited in claim 1 and including elongated tubes received through said tube holes, each of said tubes defining a passage extending therethrough.

11. A method of fabricating a heat exchanger tank comprising the steps of;

forming a single sheet of material having a cladding on at least one surface thereof to define a tank extending through a rectangular cross-section with a tube wall, a parallel joint wall spaced from the tube wall, spaced parallel sidewalls interconnecting the joint and tube walls to define a chamber having opposed open ends, forming an integral tab extending from the joint wall into the chamber, disposing a first of the sidewalls into engagement with the exterior of the tab to enclose the tab within the chamber, and brazing the first sidewall to the tab, extending the first sidewall upwardly above the joint wall and the tab to project outwardly from the joint wall to define a flange, and doubling the sheet defining the flange to further define a primary wall and a reinforcing wall.

12. A method as set forth in claim 11 further defined as extending holes through the flange for receiving fasteners therethrough to mount the tank on the cooling system.

13. A method as set forth in claim 11 further defined as forming spaced slots on the flange extending from a peripheral edge thereof toward the tab for mounting the tank to the cooling system.

14. A method as set forth in claim 11 further defined as forming a recessed area on each end of the flange extending from a peripheral edge thereof toward an adjacent end of the tank.

15. A method as set forth in claim 11 further defined as forming a U-shaped fold integrally joining the primary and reinforcing walls.

16. A method as set forth in claim 15 further defined as overlapping the primary and joint walls with the reinforcing wall.

17. A method as set forth in claim 16 further defined as brazing the reinforcing wall to the primary wall and the joint wall.

18. A method as set forth in claim 11 further defined as sealing an end cap into engagement with each of the open ends of the tank.

* * * * *